US010406415B2

(12) United States Patent
Tabeling

(10) Patent No.: US 10,406,415 B2
(45) Date of Patent: Sep. 10, 2019

(54) GOLF CLUB HEAD COVER AND METHOD OF USE

(71) Applicant: Daniel Tabeling, Noblesville, IN (US)

(72) Inventor: Daniel Tabeling, Noblesville, IN (US)

( * ) Notice: Subject to any disclaimer, the term of this patent is extended or adjusted under 35 U.S.C. 154(b) by 87 days.

(21) Appl. No.: 15/792,633

(22) Filed: Oct. 24, 2017

(65) Prior Publication Data

US 2019/0118053 A1 Apr. 25, 2019

(51) Int. Cl.
*A63B 60/62* (2015.01)
*A63B 71/02* (2006.01)

(52) U.S. Cl.
CPC ..... *A63B 60/62* (2015.10); *A63B 2071/024* (2013.01); *A63B 2209/08* (2013.01)

(58) Field of Classification Search
CPC ..... A63B 55/00; A63B 55/404; A63B 57/00; A63B 60/62
USPC ..... 150/160
See application file for complete search history.

(56) References Cited

U.S. PATENT DOCUMENTS 3,931,842 A * 1/1976 White ..... A63B 55/00 428/36.9
5,000,238 A * 3/1991 Zeller ..... A63B 60/62 150/160
7,464,812 B2 * 12/2008 Wright ..... A63B 60/62 150/159
7,584,844 B2 * 9/2009 Kvinge ..... A63B 60/62 150/160
8,225,830 B2 7/2012 Maeng et al.
2009/0133790 A1 * 5/2009 Maeng ..... A63B 60/62 150/160
2015/0047761 A1 * 2/2015 Higdon ..... A63B 60/62 150/160

* cited by examiner

*Primary Examiner* — Sue A Weaver
(74) *Attorney, Agent, or Firm* — Roberts IP Law; John Roberts

(57) ABSTRACT

An improved golf club head cover and hands-free method of use allow a user to hold a golf club normally by the handle with one or two hands while standing substantially upright and slide the golf club head into and out of the head cover while the head cover is sitting on the ground, without the user needing to bend down or touch the head cover. A rigid cover may include a concave main body pivotally connected with one or more rotating components that include tabs that close the rotating components around the golf club head and shaft when the club is inserted securely into the cover. Magnetically attractive and repulsive structures may be included to assist with keeping the cover shut and holding it open. Traction structures are provided to laterally engage grass-covered ground to resist lateral movement during hands-free use.

20 Claims, 9 Drawing Sheets

GOLF CLUB HEAD COVER AND METHOD OF USE

CROSS-REFERENCE TO RELATED APPLICATIONS

None.

FEDERALLY SPONSORED RESEARCH OR DEVELOPMENT

None.

TECHNICAL FIELD

The present invention relates to head covers for golf clubs and methods of using them.

BACKGROUND

There have been numerous attempts over the years to improve cumbersome golf club head covers. For example, U.S. Pat. No. 8,225,830 to Maeng, et al., issued Jul. 24, 2012, which is incorporated herein by reference, describes a golf club head cover design that can purportedly be operated with only one hand while holding the golf club with the other hand. However, that and other prior designs are still relatively cumbersome to use, such that many golfers simply do not use them, leading to damaged clubs. What is needed is a golf club head cover that can be removed and put back on without the user ever having to bend over or touch the head cover.

SUMMARY

The present invention(s) elegantly overcome many of the drawbacks of prior systems and provide numerous additional improvements and benefits as will be apparent to persons of skill in the art. Provided in various example embodiments is an improved golf club head cover and hands-free method of use that allow a user to hold a golf club normally by the handle with one or two hands while standing substantially upright and slide the golf club head into the head cover while the head cover is sitting on the ground, without the user needing to bend down or touch the head cover. As the golf club head is slid into the head cover, the head cover automatically closes around the golf club head so that the golf club can be rotated upside down and placed in and carried in a golf bag without the head cover coming off the golf club head. The user can then remove the golf club head from the head cover by holding the golf club normally by the handle with one or two hands while standing substantially upright, placing the covered golf club head on the ground, and sliding the golf club head out of the cover, all without the user needing to bend down or touch the head cover. As the golf club head is slid out of the head cover, the head cover automatically opens from around the golf club head so that the golf club head can be removed from the head cover. Once the golf club head is removed from the head cover, the head cover then remains standing on the ground in an open position, ready to receive the golf club head again as described above.

In various example embodiments the golf club head cover, system, and method of use may comprise a rigid cover that a head of a golf club can be placed into and removed from without a user touching the cover, the rigid cover comprising: a concave main body that is rigid; a rotating concave member that is rigid and pivotally connected with the concave main body and movable between a closed position proximate the concave main body and an open position wherein at least a portion of the rotating concave member is distal the concave main body; the concave main body defining a first open cavity therein sized and shaped to receive at least partially therein the head of the golf club when the rotating concave member is in the open position; the concave main body and the rotating concave member, when in the closed position, together defining therein a second open cavity sized and shaped to surround and at least partially cover the head of the golf club; a first tab connected with the rotating concave member, the first tab positioned, sized, and shaped to contact the head of the golf club and cause the rotating concave member to rotate from the open position to the closed position as the golf club enters the first open cavity; the rotating concave member having an inner surface positioned, sized, and shaped to contact the head of the golf club and cause the rotating concave member to rotate from the closed position to the open position as the golf club exits the first open cavity; and one or more first magnetically attractive structures positioned, when the rotating concave member is in the closed position, to urge the rotating concave member to remain in the closed position.

In various example embodiments the golf club comprises a shaft connected to the head of the golf club, and the rigid cover further comprises: the concave main body defining a slot there-through positioned, sized, and shaped to provide clearance for movement of the shaft as the head of the golf club enters and exits the first open cavity.

In various example embodiments the rigid cover further comprises: a concave upper portion that is rigid and extends longitudinally from the concave main body and defining a third open cavity therein sized and shaped to receive at least partially therein a portion of the shaft of the golf club when the golf club enters the first open cavity.

In various example embodiments the rigid cover further comprises: a rotating door that is rigid and pivotally connected with the concave upper portion and movable between a closed position proximate the concave upper portion and an open position wherein at least a portion of the rotating door is distal the concave upper portion; the concave upper portion and the rotating door, when in the closed position, together defining therein a fourth open cavity sized and shaped to surround and at least partially cover a portion of the shaft of the golf club; a second tab connected with the rotating door, the second tab positioned, sized, and shaped to contact the shaft of the golf club and cause the rotating door to rotate from the open position to the closed position as the shaft of the golf club enters the third open cavity; the rotating door having an inner surface positioned, sized, and shaped to contact the shaft of the golf club and cause the rotating door to rotate from the closed position to the open position as the shaft of the golf club exits the third open cavity; and one or more second magnetically attractive structures positioned, when the rotating door is in the closed position, to urge the rotating door to remain in the closed position.

In various example embodiments the rigid cover further comprises: one or more traction structures extending downward from an exterior surface of the concave main body, the one or more traction structures positioned, sized, and shaped to laterally engage the grass-covered ground to resist the golf club head cover from moving laterally on the grass-covered ground when the head of the golf club is placed into and removed from the rigid cover without a user touching the rigid cover.

In various example embodiments the rigid cover further comprises one or more first magnetically repulsive structures positioned, when the rotating concave member is in the open position, to urge the rotating concave member to remain in the open position. In various example embodiments the rigid cover further comprises one or more second magnetically repulsive structures positioned, when the rotating door is in the open position, to urge the rotating door to remain in the open position.

Also provided in various example embodiments is a method of placing a head of a golf club into a rigid cover without a user touching the rigid cover, comprising the steps of: providing a golf club comprising a head, shaft, and handle; providing a rigid cover as described herein with the rotating concave member in the open position; holding the golf club by the handle and guiding the head of the golf club at least partially into the first open cavity of the concave main body; and contacting the first tab with the head of the golf club and causing the rotating concave member to rotate from the open position to the closed position.

In various example embodiments the method may further comprise the steps of: holding the golf club by the handle and contacting the inner surface of the rotating concave member with the head of the golf club; overcoming the urging force of the one or more first magnetically attractive structures; causing the rotating concave member to rotate from the closed position to the open position; and guiding the head of the golf club out of the first open cavity of the concave main body.

Further provided in various example embodiments is a method of placing a head of a golf club into a rigid cover without a user touching the rigid cover, comprising the steps of: providing a golf club comprising a head, shaft, and handle; providing a rigid cover as described herein with the rotating concave member and the rotating door both in their open positions; holding the golf club by the handle and guiding the head of the golf club at least partially into the first open cavity of the concave main body; guiding the shaft of the golf club at least partially into the third open cavity of the concave upper portion; contacting the first tab with the head of the golf club and causing the rotating concave member to rotate from the open position to the closed position; and contacting the second tab with the shaft of the golf club and causing the rotating door to rotate from the open position to the closed position.

In various example embodiments the method may further comprise the steps of: holding the golf club by the handle and contacting the inner surface of the rotating concave member with the head of the golf club; contacting the inner surface of the rotating door with the shaft of the golf club; overcoming the urging force of the one or more first and second magnetically attractive structures; causing the rotating concave member to rotate from the closed position to the open position; causing the rotating door to rotate from the closed position to the open position; guiding the head of the golf club out of the first open cavity of the concave main body; and guiding the shaft of the golf club out of the third open cavity of the concave upper portion.

In various example embodiments the method steps may be performed with the one or more traction structures placed on grass-covered ground. In various example embodiments the method may further comprise the steps of: overcoming the urging force of the one or more first magnetically repulsive structures when causing the rotating concave member to rotate from the open position to the closed position, and overcoming the urging force of the one or more second magnetically repulsive structures when causing the rotating door to rotate from the open position to the closed position. In various example embodiments the method may further comprise moving the shaft in the slot during the steps of guiding the head of the golf club at least partially into, and out of, the first open cavity of the concave main body. The golf club when secured inside the cover may in certain embodiments be free-standing, upright without other support as shown in FIGS. 1 and 5.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define, or otherwise establish the scope of legal protection.

BRIEF DESCRIPTION OF THE DRAWINGS

Various example embodiments are depicted in the accompanying drawings for illustrative purposes, and should in no way be interpreted as limiting the scope of the embodiments. Furthermore, various features of different disclosed embodiments can be combined to form additional embodiments, which are also part of this disclosure. It will be understood that certain components and details may not appear in the Figure(s) to assist in more clearly describing the invention.

DETAILED DESCRIPTION OF EXAMPLE EMBODIMENTS

Figure 1:
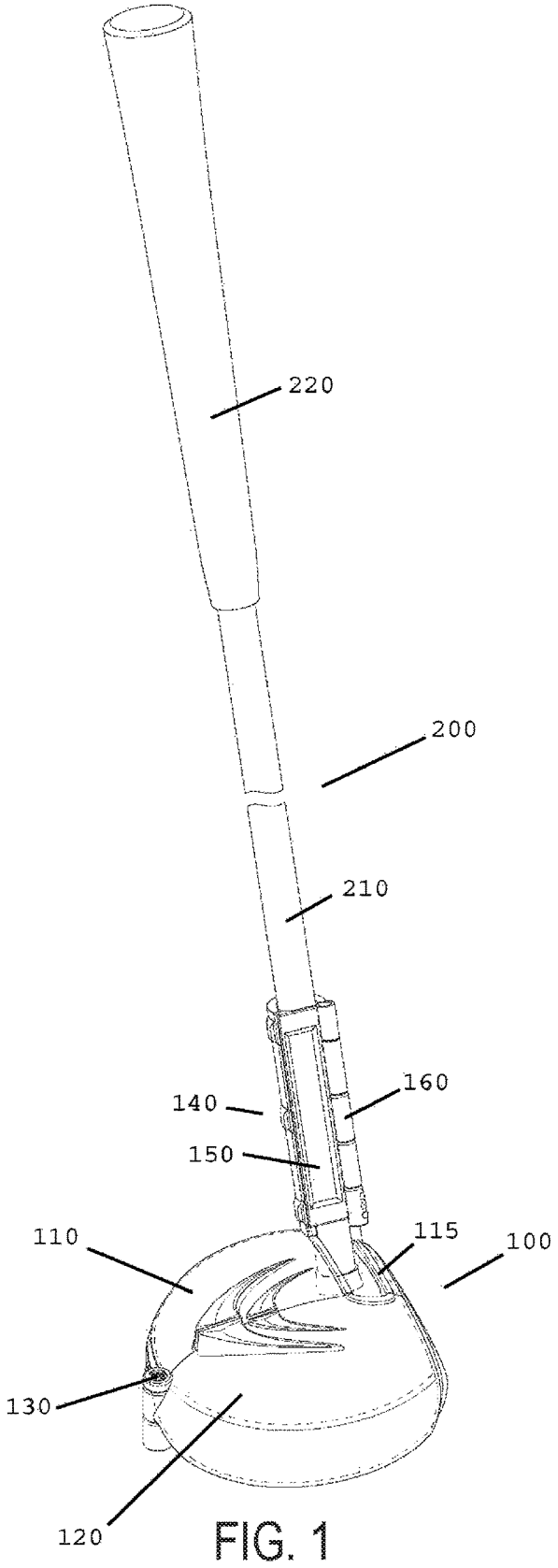
FIG. 1 is a perspective illustration of an example embodiment of a golf club head cover with the head of an example golf club positioned therein.

Reference is made herein to some specific examples embodying the present invention, including any best modes contemplated by the inventor for carrying out the invention. Examples of these specific embodiments are illustrated in the accompanying Figure(s). While examples of the invention are described in conjunction with these specific embodiments, it will be understood that this description is not intended to limit the invention to the described or illustrated embodiments. To the contrary, this description is intended to cover alternatives, modifications, and equivalents as may be included within the spirit and scope of the invention as defined by the appended claims.

In the following description, numerous specific details are set forth in order to provide a thorough understanding of the example embodiments. Particular example embodiments may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Turning to FIGS. 1-4, shown are perspective illustrations of an example golf club 200 interacting with an example embodiment of a golf club head cover 100. In various example embodiments, the golf club head cover 100 may comprise a concave main body 110 pivotally connected with a rotating concave member 120 about a pivoting joint 130.

In various example embodiments, the concave main body 110 may comprise a lower surface 112, a back surface 113, and an upper surface 114, forming there-between an open cavity 111 sized and shaped to receive at least partially therein the head 230 of a golf club 200. One or more side covers 109 may be provided that are formed as part of, or attached with, an open side 116 of the main body 110. Components may be attached by any suitable fastening means, such as glue, sonic welding, fasteners, or the like. The cavity 111 may comprise an open side 118 sized and shaped to receive at least partially therein the head 230 of a golf club 200, and to mate with a similarly sized and shaped portion of the rotating concave member 120. A pivoting joint 130 may be provided on a side 119 of the main body 110. The pivoting joint 130 can be any suitable structure, such as a hinge comprising an axle such as a screw (not shown) passing through and rotatably connected with the joint 130. A traction structure 170 may be attached with and extend downward from the lower exterior of the lower surface 112 of the main body 110. The traction structure 170 may be sized and shaped to laterally engage grass-covered ground (not shown) on which the golf club head cover 100 may sit, to resist the golf club head cover 100 from moving laterally on the grass-covered ground when the head 230 of a golf club 200 is removed from and replaced into the golf club head cover 100. Traction structure 170 may comprise any suitable geometry, such as an arc, spikes, fins, or the like, for example.

In various example embodiments a concave upper portion 140 may be provided extending upward from the upper surface 114 of the main body 110, defining an open cavity 147 generally facing in the same direction as the open side 118, the open cavity 147 being sized and shaped to receive at least partially therein a portion of the shaft 210 of the golf club 200. A slot 115 may be formed in the upper surface 114 of the main body 110 extending from the open cavity 147 of the concave upper portion 140 to the open side 118 of the main body 110. The slot 115 may be sized and shaped to permit a portion of the shaft 210 of the golf club 200 to move within the slot to allow the golf club head 230 to be placed in and removed from the golf club head cover 100.

A rotating upper door 150 may be provided that is pivotally connected with the concave upper portion 140 about a pivoting joint 160. The pivoting joint 160 can comprise any suitable structure, such as a hinge comprising an axle (not shown) passing through and rotatably connected with the joint 160. The rotating upper door 150 may be sized and shaped to cover, when shut, at least a portion of the open cavity 147 of the concave upper portion 140. A side of the upper concave portion 140 opposite the pivoting joint 160 may be provided with one or more magnetically attractive structures 145, positioned opposite and adjacent corresponding magnetically attractive structures 155 located in the door 150. Magnetically attractive structures 145, 155 are adapted to attract each other, and each may comprise any of a magnet having a first polarity, a magnet having a second polarity opposite the first polarity, and a metallic structure to which magnets attract. The magnetically attractive structures 145, 155 cooperate to hold the rotating upper door 150 closed against the upper concave portion 140 when the golf club head 230 is located in the golf club head cover 100 and the shaft 210 of the golf club 200 is located in the upper concave portion 140.

Figure 2:
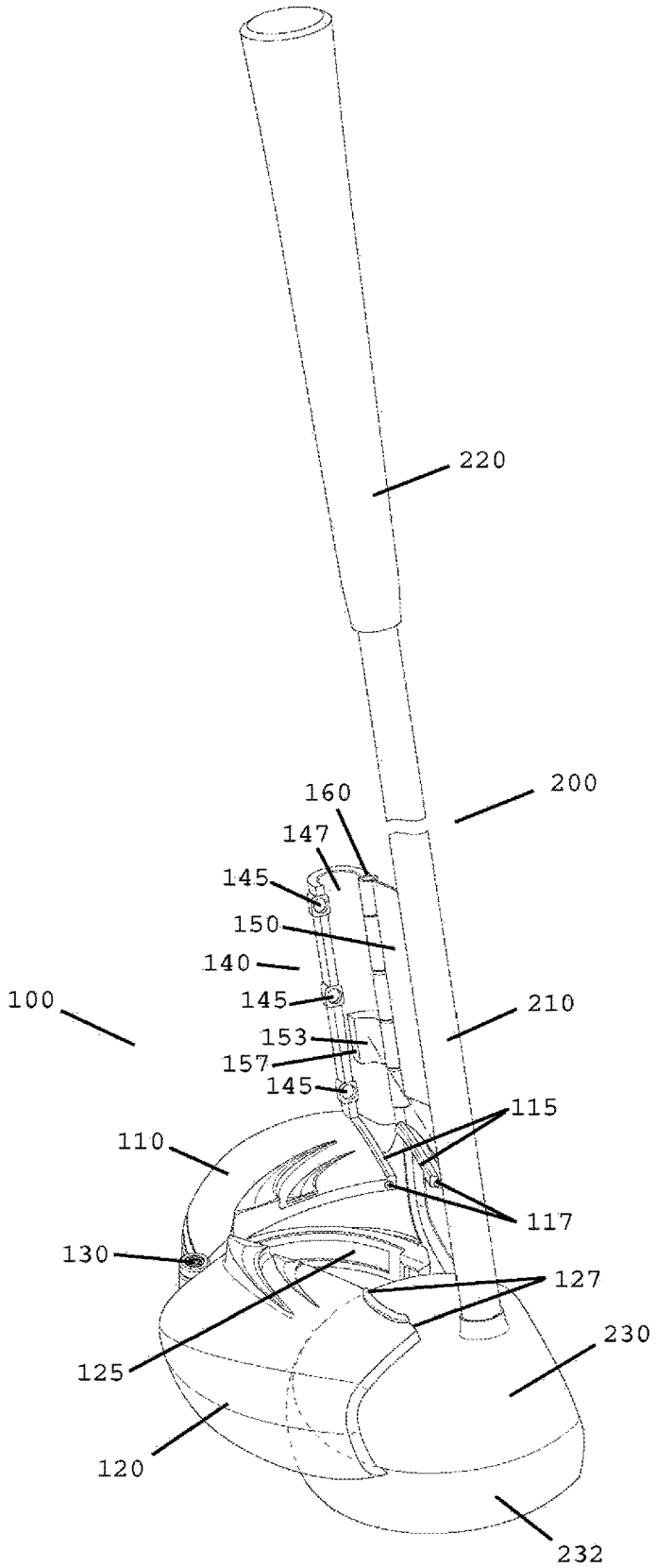
FIG. 2 is a perspective illustration of the golf club head cover of FIG. 1, showing the head of the golf club being removed therefrom.
Figure 3:
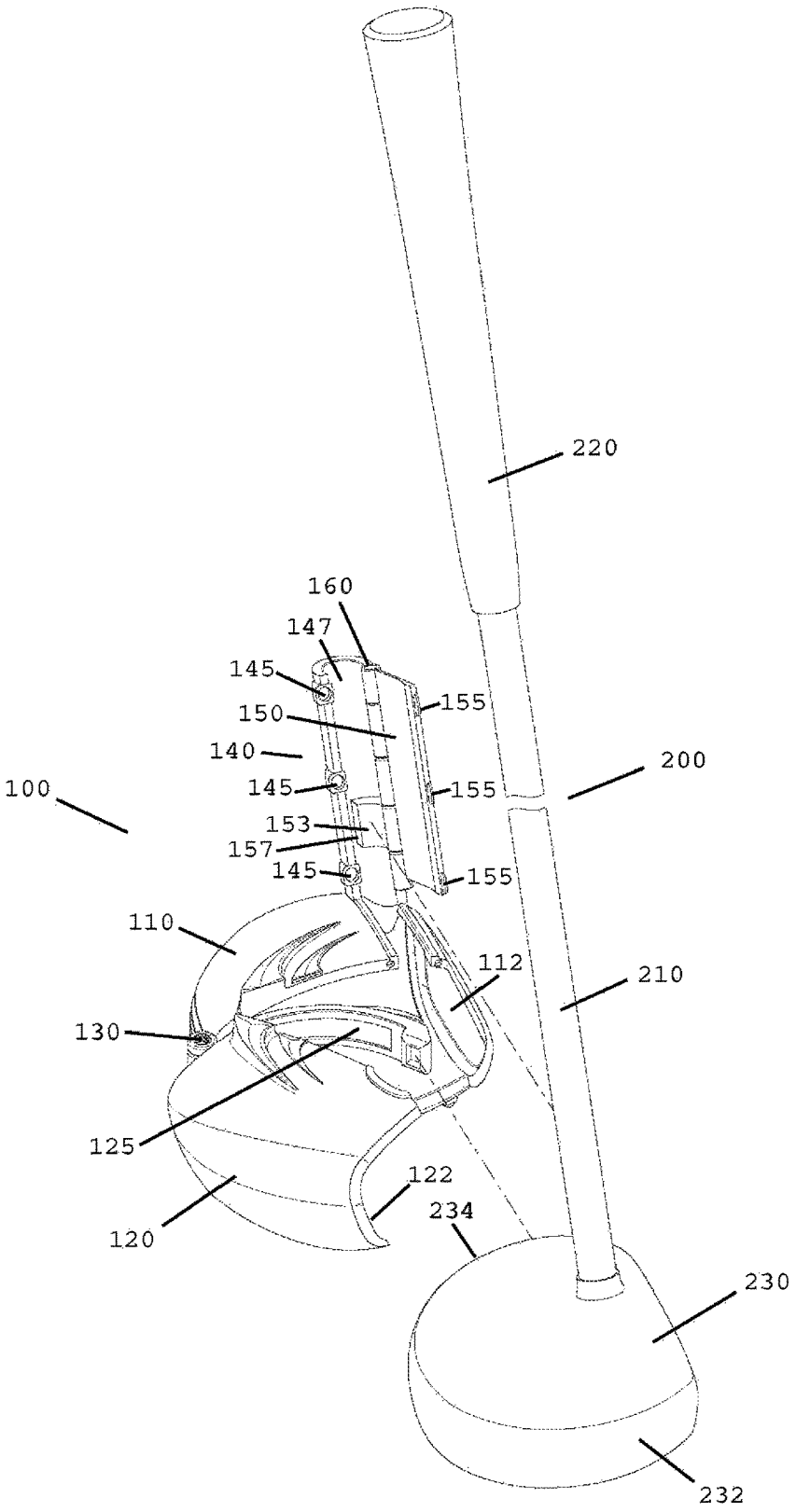
FIG. 3 is a perspective illustration of the golf club head cover of FIG. 1, showing the head of the golf club fully removed therefrom.
Figure 4:
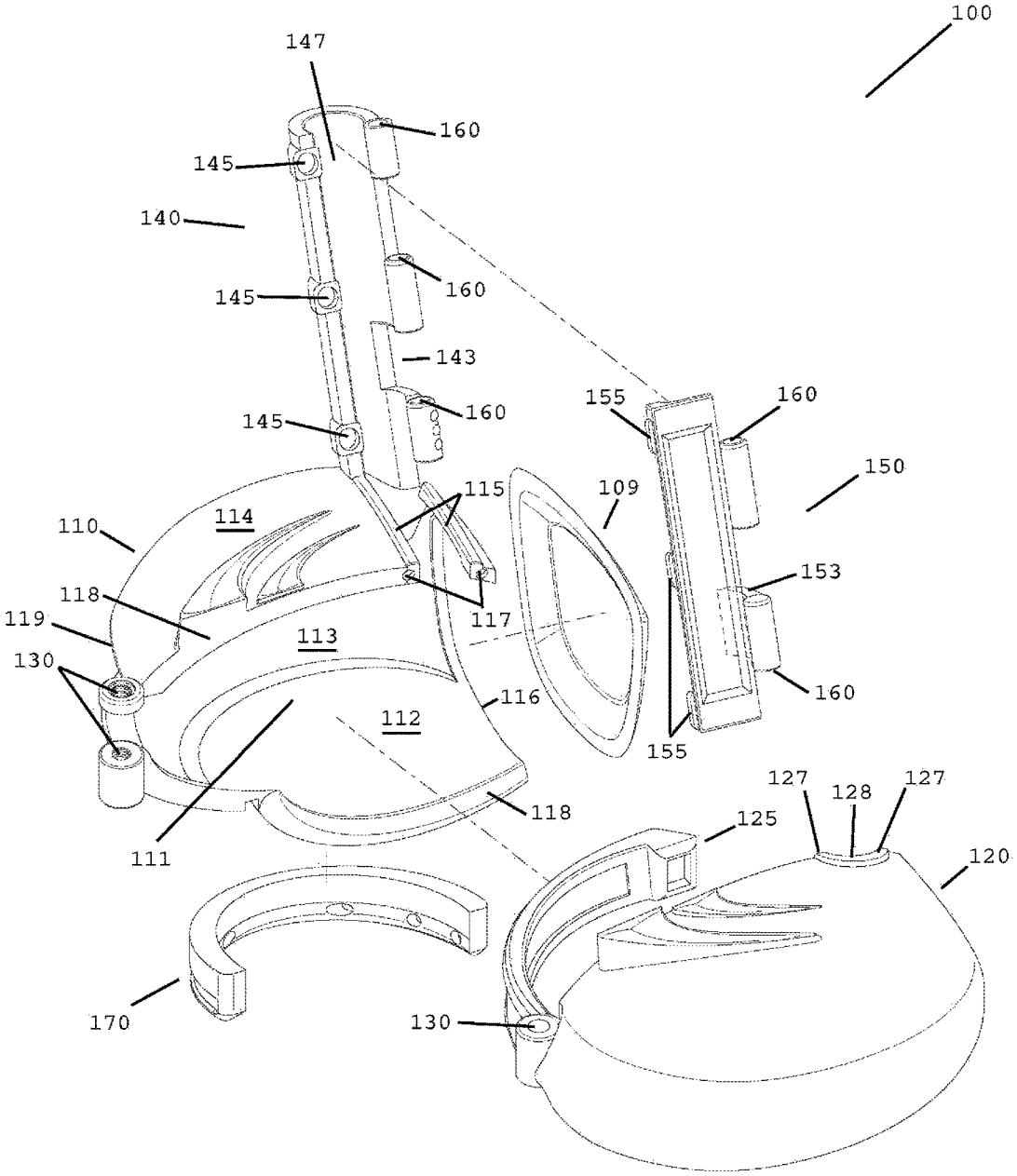
FIG. 4 is an exploded perspective illustration of the example golf club head cover of FIG. 1.

The rotating upper door 150 may be provided with a first tab 153 that extends roughly perpendicularly from rest of the body of the door 150, for instance as shown in FIGS. 3 and 4. The first tab 153 may be configured to fit within a tab opening 143 formed in the upper concave portion 140 when the rotating upper door 150 is closed against the upper concave portion 140, for instance when the golf club 200 is located in the golf club head cover 100 and the shaft 210 of the golf club 200 is located in the upper concave portion 140, as depicted in FIG. 1. But when the rotating upper door 150 is rotated about pivoting joint 160 to an open position, for instance when the golf club head 230 is removed from the golf club head cover 100 and the shaft 210 of the golf club 200 is removed from the upper concave portion 140 as shown in FIGS. 2 and 3, then first tab 153 extends into the open cavity 147 of the concave upper portion 140.

In various example embodiments, a distal end 157 of the first tab 153 may be provided with one or more magnetically repulsive structures (not shown), such as a magnet of a first polarity, while a magnet of the same, first polarity (not shown) may be provided on a corresponding portion of the concave upper portion 140 that is proximate the distal end 157 of the first tab 153 when the rotating upper door 150 is rotated about pivoting joint 160 to an open position, as shown in FIG. 3. In such example embodiments, the proximate positioning of repelling magnets of the same polarity on the distal end 157 of the first tab 153 and the corresponding portion of the concave upper portion 140 tends to push on the distal end 157 of the first tab 153, thereby pushing and holding the rotating upper door 150 in the open position as shown in FIG. 3 once the magnet (not shown) on the distal end 157 of the first tab 153 passes the position of the repelling magnet (not shown) on the upper concave portion 140.

The first tab 153 functions to close the rotating upper door 150 against the concave upper portion 140 when the golf club head 230 is moved into the golf club head cover 100 and the shaft 210 of the golf club 200 is moved into the open cavity 147 of the upper concave portion 140. This happens when the shaft 210 of the golf club 200 contacts then pushes against and moves the first tab 153 past any resisting magnetic forces into the tab opening 143 as the shaft 210 enters the open cavity 147 of the upper concave portion 140, causing the rotating upper door 150 to simultaneously rotate about pivoting joint 160 to the closed position against upper concave portion 140, to the position shown in FIG. 1.

When the golf club head 230 is moved out of the golf club head cover 100, the shaft 210 of the golf club 200 is moved out of the open cavity 147 of the upper concave portion 140 by opening the rotating upper door 150 by rotating the door 150 about pivoting joint 160 to an open position, as shown in FIG. 3. This happens when the shaft 210 of the golf club 200 contacts then pushes against the back side of the rotating upper door 150 (the side facing open cavity 147) with enough force to overcome the magnetic attraction forces of the magnetically attractive structures 145, 155. The shaft 210 of the golf club 200 is then moved out of the open cavity 147 of the upper concave portion 140 and through the slot 115 in the upper portion 114 of the concave main body 110 to the positions shown in FIGS. 2 and 3.

Rotating concave member 120 may include an inner surface 122 sized and shaped to receive at least partially therein the head 230 of a golf club 200. Rotating concave member 120 may include part of the pivoting joint 130 positioned with the pivoting joint 130 on a side 119 of the main body 110. The rotating concave member 120 may be sized and shaped to cover, when shut, at least a portion of the open cavity 111 of the concave main body 110. A side of the rotating concave member 120 opposite the pivoting joint 130 may be provided with one or more magnetically attractive structures 127, positioned opposite and adjacent corresponding magnetically attractive structures 117 on the concave main body 110. Magnetically attractive structures 127, 117, are adapted to attract each other, and each may comprise any of a magnet having a first polarity, a magnet having a second polarity opposite the first polarity, and a metallic structure to which magnets attract. The magnetically attractive structures 127, 117 cooperate to hold the rotating concave member 120 closed against the concave main body 110 when the golf club head 230 is located in the golf club head cover 100, for instance as shown in FIG. 1.

A second tab 125 may extend from rotating concave member 120, for instance beginning at the pivoting joint 130, into the open cavity 111 of the concave main body 110. The second tab 125 may be any suitable shape and size. For example, second tab 125 may be curved as shown in the Figures, and may be sized, shaped, and located to function similarly as first tab 153, in that the second tab 125 causes the rotating concave member 120 to shut against the open side 118 of the concave main body 110 when the golf club head 230 is moved into the open cavity 111 of the concave main body 110 to the position shown in FIG. 1. This happens when a first side 234 of the head 230 of the golf club 200 contacts then pushes against and moves the second tab 125 past any resisting magnetic forces into the open cavity 111 of the concave main body 110, causing the rotating concave member 120 to simultaneously rotate about pivoting joint 130 to the closed position against concave main body 110, to the position shown in FIG. 1. In various example embodiments, when the golf club head 230 is moved into the golf club head cover 100 and the rotating concave member 120 is rotated about pivoting joint 130 to the closed position against concave main body 110, to the position shown in FIG. 1, the golf club head 230 may be substantially or totally surrounded and covered by the golf club head cover 100.

In various example embodiments, a distal end of the second tab 125 may be provided with one or more magnetically repulsive structures (not shown), such as a magnet of a first polarity, while a magnet of the same, first polarity (not shown) may be provided on a corresponding portion of the one or more side covers 109 that are proximate the distal end of the second tab 125 when the rotating concave member 120 is rotated about pivoting joint 130 to an open position, as shown in FIG. 3. In such example embodiments, the proximate positioning of repelling magnets of the same polarity on the distal end of the second tab 125 and the corresponding portion of the one or more side covers 109 tend to push on the distal end of the second tab 125, thereby pushing and holding the rotating concave member 120 in the open position as shown in FIG. 3 once the magnet (not shown) on the distal end of the second tab 125 passes the position of the repelling magnet (not shown) on the one or more side covers 109.

When the golf club head 230 is moved out of the golf club head cover 100, the golf club head 230 is moved out of the open cavity 111 of the concave main body 110 by opening the rotating concave member 120 by rotating the concave portion 120 about pivoting joint 130 to an open position, as shown in FIG. 3. This happens when a second side 232 of the head 230 of the golf club 200 contacts then pushes against the inner surface 122 of the rotating concave member 120 with enough force to overcome the magnetic attraction forces of the magnetically attractive structures 117, 127. The golf club head 230 is then moved out of the open cavity 111 of the concave main body 110 to the positions shown in FIGS. 2 and 3 while the shaft 210 of the golf club 200 is simultaneously moved out of the open cavity 147 of the upper concave portion 140 and through the slot 115 in the upper portion 114 of the concave main body 110 to the positions shown in FIGS. 2 and 3. After the shaft 210 of the golf club 200 is moved through the slot 115, the shaft 210 might touch a surface 128 on the rotating concave member 120, thereby further rotating the concave portion 120 about pivoting joint 130 to a further open position. The golf club head 230 and shaft 210 may then be moved back into the open cavities 111 and 147, respectively, causing the rotating concave member 120 and the rotating upper door 150 to return to the closed or shut positions shown in FIG. 1.

The example golf club head cover 100 will now be described in use. A user (not shown) may hold a golf club 200 normally by the handle 220 with one or two hands (not shown) while standing substantially upright, for instance in a similar posture as when the user swings the golf club 200 when swinging or putting. An example golf club head cover 100 is provided, sitting with traction structure 170 on grass-covered ground (not shown), in the open position as shown FIG. 3. The user slides the golf club head 230 into the head cover 100 while the head cover 100 is sitting on the ground, without the user needing to bend down or touch the head cover 100. As the golf club head 230 is slid into the head cover 100, the head cover 100 automatically closes around the golf club head 230 by the concave portion 120 rotating about pivoting joint 130 and the upper door 150 rotating about pivoting joint 160, due to the golf club head 230 pushing on the second tab 125 and the golf club shaft 210 pushing on the first tab 153. Once the head cover 100 is closed around the golf club head 230, the golf club 200 can be rotated upside down and placed in and carried in a golf bag (not shown) without the head cover 100 coming off the golf club head 230, due to the magnetic attraction forces of the magnetically attractive structures 117, 127 and 145, 155 holding shut the rotating concave member 120 and the rotating upper door 150.

The user can then remove the golf club head 230 from the head cover 100 by holding the golf club 200 normally by the handle 220 with one or two hands while standing substantially upright, for instance in a similar posture as when the user swings the golf club 200 when swinging or putting. The user can place the covered golf club head on the ground, sitting with traction structure 170 on grass-covered ground (not shown), in the closed position as shown FIG. 1. The user can then slide the golf club head 230 out of the cover 100, all without the user needing to bend down or touch the head cover 100. As the golf club head 230 is slid out of the head cover 100, the head cover 100 automatically opens from around the golf club head 230 so that the golf club head 230 can be removed from the head cover 100. As the golf club head 230 and shaft 210 are pushed out of the head cover 100 with sufficient force against the rotating concave member 120 and the rotating upper door 150 to overcome the magnetic attraction forces of the magnetically attractive structures 117, 127 and 145, 155, the head cover 100 automatically opens around the golf club head 230 by the concave portion 120 rotating about pivoting joint 130 and the upper door 150 rotating about pivoting joint 160. Once the golf club head 230 is removed from the head cover 100, the head cover 100 then remains standing on the ground in an open position, for instance as shown in FIG. 3, ready to receive the golf club head 230 again as described above.

It is understood that the example golf club head cover 100 shown in the figures and described herein is just one example embodiment provided to illustrate various concepts. Many other designs could be implemented using the concepts provided, for many different golf club types, shapes, and sizes. For example, one such additional example design is shown in FIGS. 5-9, which illustrate another example golf club 2000 interacting with another example embodiment of a golf club head cover 1000. In various example embodiments, the golf club head cover 1000 may comprise a concave main body 1100 pivotally connected with a rotating concave member 1200 about a pivoting joint 1300.

With continued reference to FIGS. 5-9, in various example embodiments, the concave main body 1100 may comprise a lower surface 1120, a back surface 1130, and an upper surface 1140, forming there-between an open cavity 1110 sized and shaped to receive at least partially therein the head 2300 of a golf club 2000. One or more side portions 1090 may be formed on a side of the main body 1100, sized and shaped to mate with a similarly sized and shaped portion 1270 of the rotating concave member 1200. A pivoting joint 1300 may be provided on a side of the main body 1100 opposite the side portions 1090. The pivoting joint 1300 can be any suitable structure, such as a hinge comprising an axle such as a screw (not shown) passing through and rotatably connected with the joint 1300. A traction structure 1700 may be attached with and extend downward from the lower exterior of the lower surface 1120 of the main body 1100. The traction structure 1700 may be sized and shaped to laterally engage grass-covered ground (not shown) on which the golf club head cover 1000 may sit, to resist the golf club head cover 1000 from moving laterally on the grass-covered ground when the head 2300 of a golf club 2000 is removed from and replaced into the golf club head cover 1000. Traction structure 1700 may comprise any suitable geometry, such as an arc, spikes, fins, or the like, for example. A slot 1150 may be formed in the upper surface 1140 of the main body 1100 extending from a back surface 1130 of the main body 1100 to the open cavity 1110 of the main body 1100. The slot 1150 may be sized and shaped to permit a portion of the shaft 2100 of the golf club 2000 to move within the slot to allow the golf club head 2300 to be placed in and removed from the golf club head cover 1000.

Figure 5:
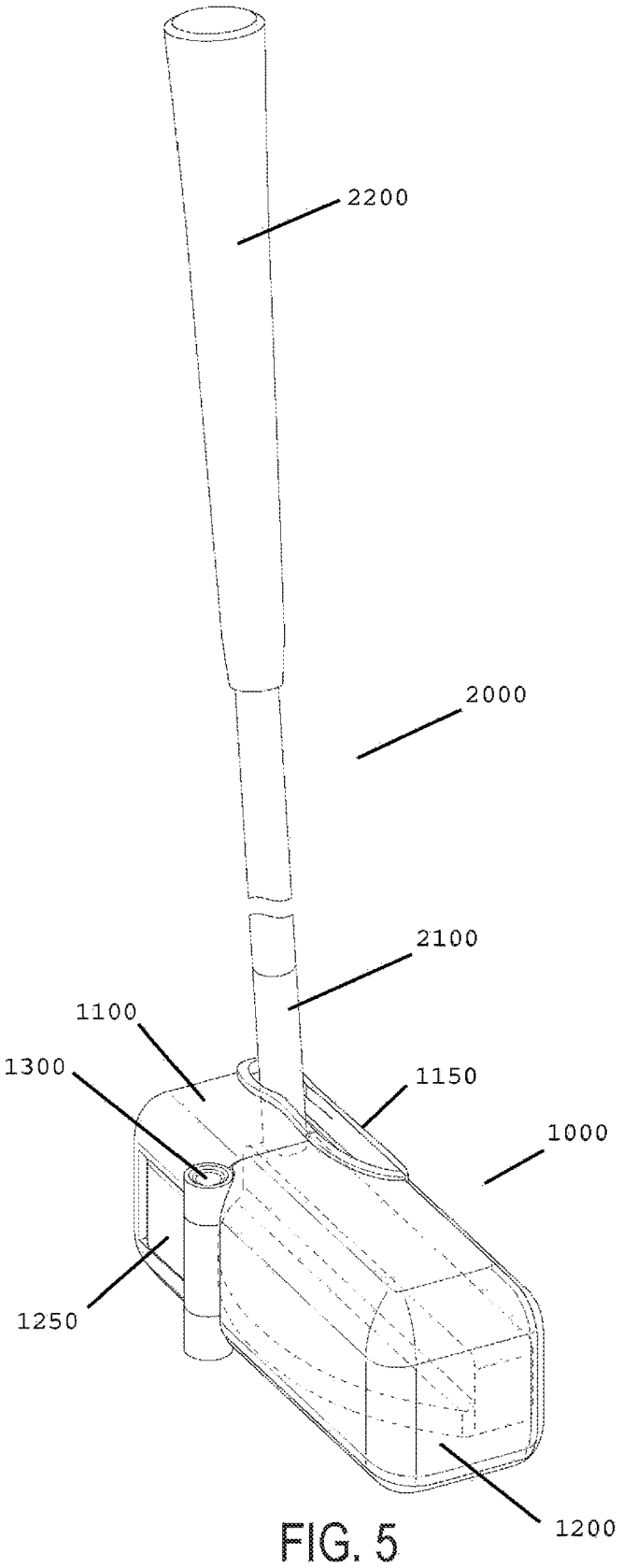
FIG. 5 is a perspective illustration of another example embodiment of a golf club head cover with the head of another example golf club positioned therein.
Figure 6:
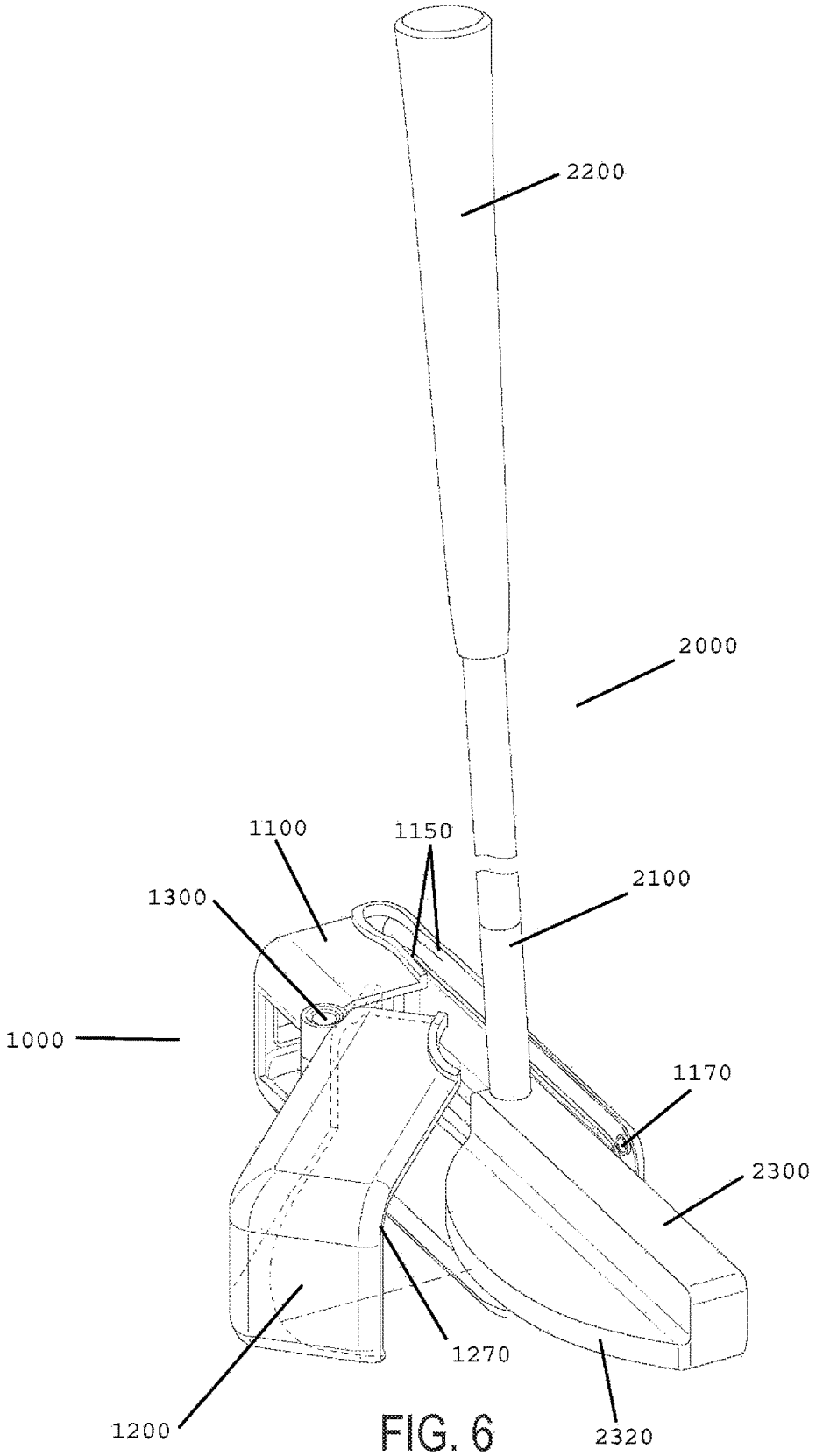
FIG. 6 is a perspective illustration of the golf club head cover of FIG. 5, showing the head of the golf club being removed therefrom.

Rotating concave member 1200 may include a front portion 1224, a side portion 1221, and an upper portion 1227, defining an inner surface 1220 sized and shaped to receive at least partially therein the head 2300 of a golf club 2000. Rotating concave member 1200 may include part of the pivoting joint 1300 positioned with the pivoting joint 1300 on a side of the main body 1100. The rotating concave member 1200 may be sized and shaped to cover, when shut, at least a portion of the open cavity 1110 of the concave main body 1100. A side 1228 of the rotating concave member 1200 opposite the pivoting joint 1300 may be provided with one or more magnetically attractive structures 1270, positioned opposite and adjacent corresponding magnetically attractive structures 1170 on the concave main body 1100. Magnetically attractive structures 1270, 1170, are adapted to attract each other, and each may comprise any of a magnet having a first polarity, a magnet having a second polarity opposite the first polarity, and a metallic structure to which magnets attract. The magnetically attractive structures 1270, 1170 cooperate to hold the rotating concave member 1200 closed against the concave main body 1100 when the golf club head 2300 is located in the golf club head cover 1000, for instance as shown in FIG. 5.

A tab 1250 may extend from the pivoting joint 1300 distally rearward and parallel to the side portion 1221. The tab 1250 may be sized, shaped, and located to function similarly as tab 125, in that the tab 1250 causes the rotating concave member 1200 to shut against the concave main body 1100 when the golf club head 2300 is moved into the open cavity 1110 of the concave main body 1100 to the position shown in FIG. 5.

Figure 7:
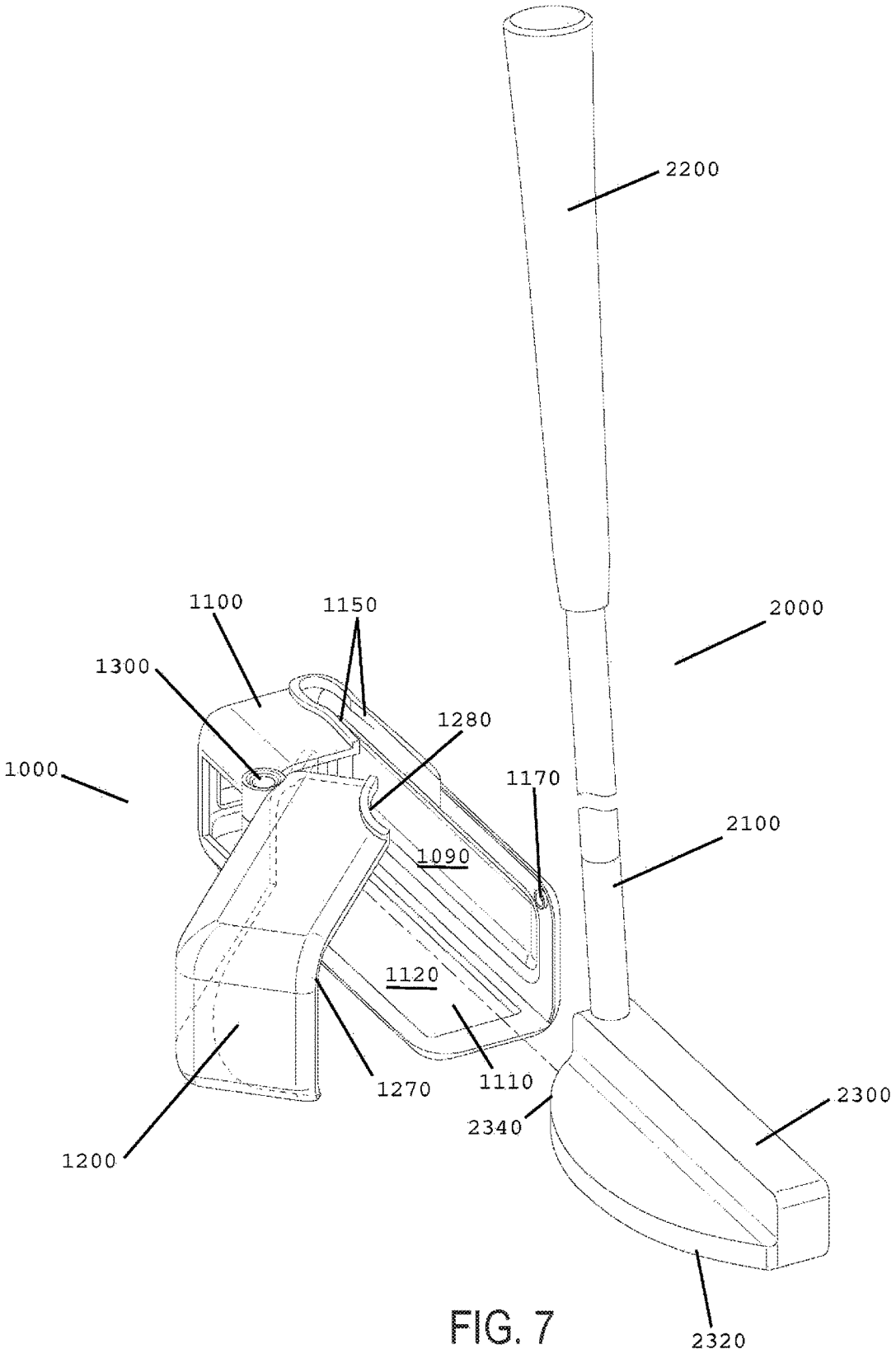
FIG. 7 is a perspective illustration of the golf club head cover of FIG. 5, showing the head of the golf club fully removed therefrom.
Figure 8:
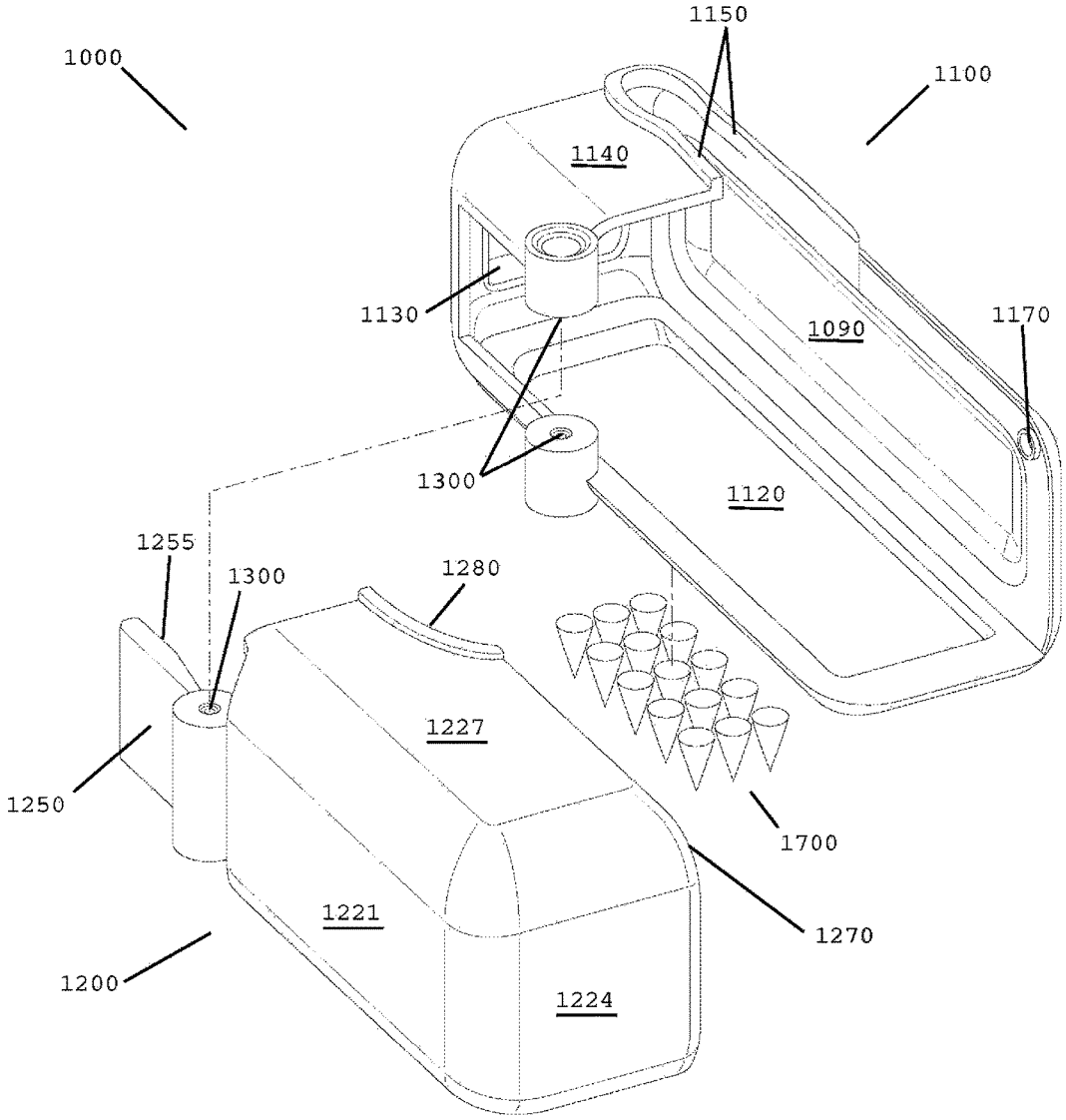
FIG. 8 is an exploded perspective illustration of the example golf club head cover of FIG. 5.
Figure 9:
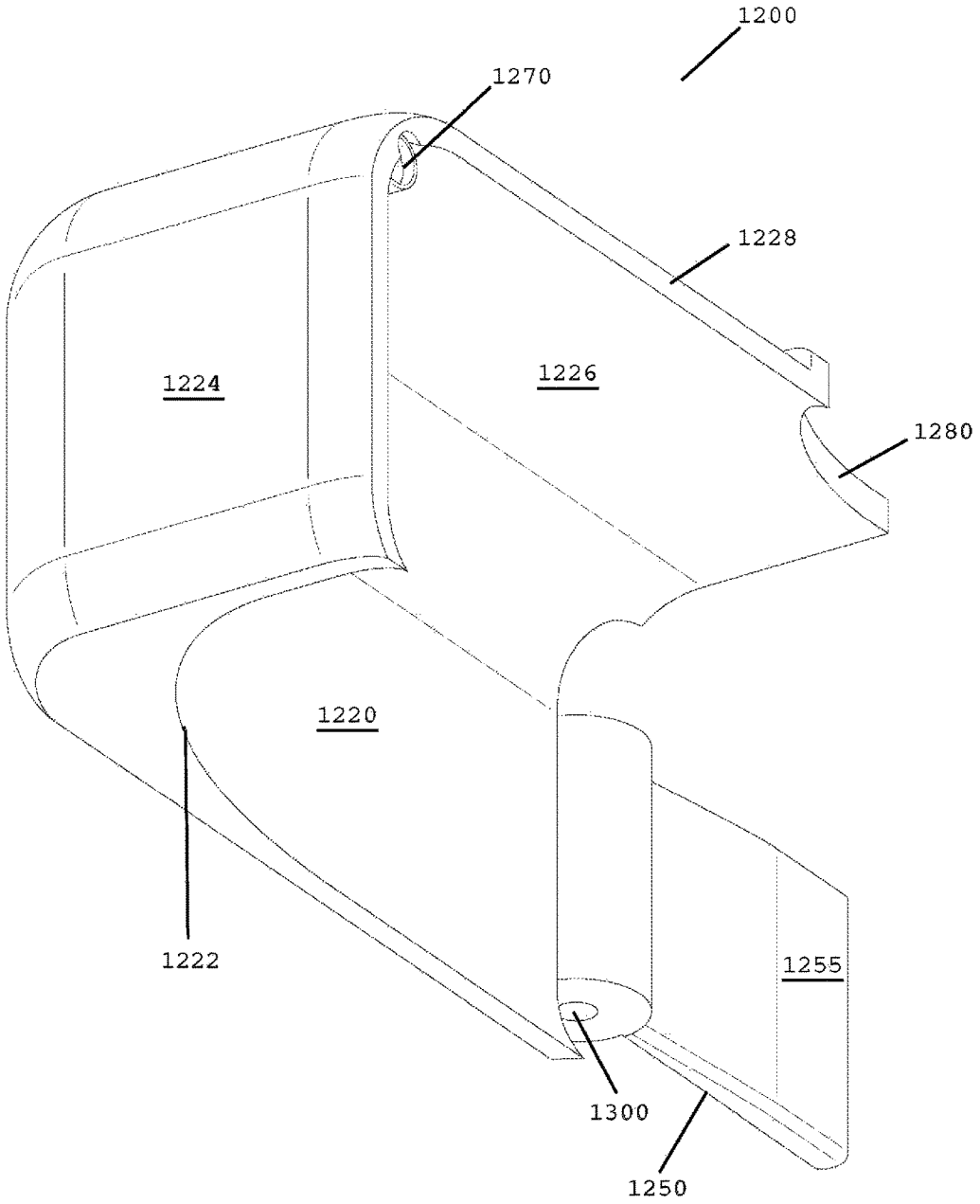
FIG. 9 is a bottom perspective illustration of a portion of the example golf club head cover of FIG. 5.

In various example embodiments, a distal end of the tab 1250 may be provided with one or more magnetically attractive structures (not shown), such as a magnet of a first polarity, while a magnet of the same, first polarity (not shown) may be provided on a corresponding portion of the back surface 1130 that is proximate the distal end of the tab 1250 when the rotating concave member 1200 is rotated about pivoting joint 1300 to an open position, as shown in FIG. 7. In such example embodiments, the proximate positioning of repelling magnets of the same polarity on the distal end of the tab 1250 and the corresponding portion of the back surface 1130 tend to push on the distal end of the tab 1250, thereby pushing and holding the rotating concave member 1200 in the open position as shown in FIG. 7 once the magnet (not shown) on the distal end of the tab 1250 passes the position of the repelling magnet (not shown) on the back surface 1130.

The tab 1250 functions to close the rotating concave member 1200 against the concave main body 1100 when the golf club head 2300 is moved into the golf club head cover 1000. This happens when a first side 2340 of the head 2300 of the golf club 2000 contacts then pushes against inner surface 1255 of tab 1250 and moves the tab 1250 past any resisting magnetic forces, causing the rotating concave member 1200 to simultaneously rotate about pivoting joint 1300 to the closed position against concave main body 1100, to the position shown in FIG. 5. In various example embodiments, when the golf club head 2300 is moved into the golf club head cover 1000 and the rotating concave member 1200 is rotated about pivoting joint 1300 to the closed position against concave main body 1100, to the position shown in FIG. 5, the golf club head 2300 may be substantially or totally surrounded and covered by the golf club head cover 1000.

When the golf club head 2300 is moved out of the golf club head cover 1000, the golf club head 2300 is moved out of the open cavity 1110 of the concave main body 1100 by opening the rotating concave member 1200 by rotating the concave portion 1200 about pivoting joint 1300 to an open position, as shown in FIG. 7. This happens when a second side 2320 of the head 2300 of the golf club 2000 contacts then pushes against the inner surface 1220 of the rotating concave member 1200 with enough force to overcome the magnetic attraction forces of the magnetically attractive structures 1170, 1270. Specifically, the second side 2320 of the head 2300 of the golf club 2000 pushes against the curved surface 1222, forcing and rotating open the rotating concave member 1200. The golf club head 2300 is then moved out of the open cavity 1110 of the concave main body 1100 to the positions shown in FIGS. 6 and 7 while the shaft 2100 of the golf club 2000 is simultaneously moved out through the slot 1150 in the upper portion 1140 of the concave main body 1100 to the positions shown in FIGS. 6 and 7. After the shaft 2100 of the golf club 2000 is moved through the slot 1150, the shaft 2100 might touch a surface 1280 on the rotating concave member 1200, thereby further rotating the concave portion 1200 about pivoting joint 1300 to a further open position.

The example golf club head cover 1000 will now be described in use. A user (not shown) may hold a golf club 2000 normally by the handle 2200 with one or two hands (not shown) while standing substantially upright, for instance in a similar posture as when the user swings the golf club 2000 when swinging or putting. An example golf club head cover 1000 is provided, sitting with traction structure 1700 on grass-covered ground (not shown), in the open position as shown FIG. 7. The user slides the golf club head 2300 into the head cover 1000 while the head cover 1000 is sitting on the ground, without the user needing to bend down or touch the head cover 1000. As the golf club head 2300 is slid into the head cover 1000, the head cover 1000 automatically closes around the golf club head 2300 by the concave portion 1200 rotating about pivoting joint 1300 due to the golf club head 2300 pushing on the tab 1250. Once the head cover 1000 is closed around the golf club head 2300, the golf club 2000 can be rotated upside down and placed in and carried in a golf bag (not shown) without the head cover 1000 coming off the golf club head 2300, due to the magnetic attraction forces of the magnetically attractive structures 1170, 1270 holding shut the rotating concave member 1200.

The user can then remove the golf club head 2300 from the head cover 1000 by holding the golf club 2000 normally by the handle 2200 with one or two hands while standing substantially upright, for instance in a similar posture as when the user swings the golf club 2000 when swinging or putting. The user can place the covered golf club head on the ground, sitting with traction structure 1700 on grass-covered ground (not shown), in the closed position as shown FIG. 5. The user can then slide the golf club head 2300 out of the cover 1000, all without the user needing to bend down or touch the head cover 1000. As the golf club head 2300 is slid out of the head cover 1000, the head cover 1000 automatically opens from around the golf club head 2300 so that the golf club head 2300 can be removed from the head cover 1000. As the golf club head 2300 and shaft 2100 are pushed out of the head cover 1000 with sufficient force against curved or angled surface(s) 1222 on the interior surface 1220 of the rotating concave member 1200 to overcome the magnetic attraction forces of the magnetically attractive structures 1170, 1270, the head cover 1000 automatically opens around the golf club head 2300 by the concave portion 1200 rotating about pivoting joint 1300. Once the golf club head 2300 is removed from the head cover 1000, the head cover 1000 then remains standing on the ground in an open position, for instance as shown in FIG. 7, ready to receive the golf club head 2300 again as described above.

It is understood that the profiles of the tabs 125, 1250, 1255 and inner surfaces 122, 1220, 1222 may be adapted in size and shape as appropriate to function as described herein for any of a variety of shapes and sizes of golf club heads, such as golf club heads 230, 2300 or other golf club heads. The various components of the golf club head covers 100, 1000 may be formed from any suitable rigid materials, such as metal or injection-molded nylon plastic, for example. The magnets may be any suitably strong commercially-available magnets, such as Neodymium magnet discs, blocks, or spheres, and may be molded in-place in various example embodiments. Golf club head covers 100, 1000 may be upholstered (not shown) entirely or partially on their exterior or interior surfaces or both, and padding, such as foam padding (not shown) may be provided on any or all of the interior surfaces to provide sound deadening and abrasion protection for the heads 230, 2300 and lower portions of the shafts 210, 2100 of the golf clubs 200, 2000. The golf club head covers 100, 1000 may be configured in size, shape, and materials to have sufficient mass to hold the golf clubs 200, 2000 upright and free-standing without other support as shown in FIGS. 1 and 5 when the golf club head covers 100, 1000 are sitting on grass-covered ground. In various example embodiments, the cover 100, 1000 may hold the golf club head 230, 2300 securely enough that a user can swing the golf club 200, 2000 for practice with the extra weight of the cover 100, 1000 on the golf club head 230, 2300. As used herein, the term "rigid" means unlikely to bend or be forced out of shape during normal use; i.e., not flexible like a golf club head cover made only of cloth.

Any of the suitable technologies and materials set forth and incorporated herein may be used to implement various example aspects of the invention as would be apparent to one of skill in the art. Although exemplary embodiments and applications of the invention have been described herein including as described above and shown in the included example Figure(s), there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A rigid cover that a head of a golf club can be placed into and removed from without a user touching the cover, the rigid cover comprising:

a concave main body that is rigid;

a rotating concave member that is rigid and pivotally connected with the concave main body and movable between a closed position proximate the concave main body and an open position wherein at least a portion of the rotating concave member is distal the concave main body;

the concave main body defining a first open cavity therein sized and shaped to receive at least partially therein the head of the golf club when the rotating concave member is in the open position;

the concave main body and the rotating concave member, when in the closed position, together defining therein a second open cavity sized and shaped to surround and at least partially cover the head of the golf club;

a first tab connected with the rotating concave member, the first tab positioned, sized, and shaped to contact the head of the golf club and cause the rotating concave member to rotate from the open position to the closed position as the golf club enters the first open cavity;

the rotating concave member having an inner surface positioned, sized, and shaped to contact the head of the golf club and cause the rotating concave member to rotate from the closed position to the open position as the golf club exits the first open cavity; and one or more first magnetically attractive structures positioned, when the rotating concave member is in the closed position, to urge the rotating concave member to remain in the closed position; and one or more first magnetically repulsive structures positioned, when the rotating concave member is in the open position, to urge the rotating concave member to remain in the open position.

2. The rigid cover of claim 1, wherein the golf club comprises a shaft connected to the head of the golf club, the rigid cover further comprising:

the concave main body defining a slot there-through positioned, sized, and shaped to provide clearance for movement of the shaft as the head of the golf club enters and exits the first open cavity.

3. The rigid of claim 1, wherein the golf club comprises a shaft connected to the head of the golf club, the rigid cover further comprising:

a concave upper portion that is rigid and extends longitudinally from the concave main body and defining a third open cavity therein sized and shaped to receive at least partially therein a portion of the shaft of the golf club when the golf club enters the first open cavity.

4. The rigid cover of claim 3, further comprising:

a rotating door that is rigid and pivotally connected with the concave upper portion and movable between a closed position proximate the concave upper portion and an open position wherein at least a portion of the rotating door is distal the concave upper portion;

the concave upper portion and the rotating door, when in the closed position, together defining therein a fourth open cavity sized and shaped to surround and at least partially cover a portion of the shaft of the golf club;

a second tab connected with the rotating door, the second tab positioned, sized, and shaped to contact the shaft of the golf club and cause the rotating door to rotate from the open position to the closed position as the shaft of the golf club enters the third open cavity;

the rotating door having an inner surface positioned, sized, and shaped to contact the shaft of the golf club and cause the rotating door to rotate from the closed position to the open position as the shaft of the golf club exits the third open cavity; and one or more second magnetically attractive structures positioned, when the rotating door is in the closed position, to urge the rotating door to remain in the closed position.

5. The rigid cover of claim 1, configured to rest on grass-covered ground, the rigid cover further comprising:

one or more traction structures extending downward from an exterior surface of the concave main body, the one or more traction structures positioned, sized, and shaped to laterally engage the grass-covered ground to resist the golf club head cover from moving laterally on the grass-covered ground when the head of the golf club is placed into and removed from the rigid cover without a user touching the rigid cover.

6. The rigid cover of claim 1, further comprising:

a concave upper portion that is rigid and extends longitudinally from the concave main body and defining a third open cavity therein sized and shaped to receive at least partially therein a portion of the shaft of the golf club when the golf club enters the first open cavity;

a rotating door that is rigid and pivotally connected with the concave upper portion and movable between a closed position proximate the concave upper portion and an open position wherein at least a portion of the rotating door is distal the concave upper portion;

the concave upper portion and the rotating door, when in the closed position, together defining therein a fourth open cavity sized and shaped to surround and at least partially cover a portion of the shaft of the golf club;

a second tab connected with the rotating door, the second tab positioned, sized, and shaped to contact the shaft of the golf club and cause the rotating door to rotate from the open position to the closed position as the shaft of the golf club enters the third open cavity;

the rotating door having an inner surface positioned, sized, and shaped to contact the shaft of the golf club and cause the rotating door to rotate from the closed position to the open position as the shaft of the golf club exits the third open cavity;

one or more second magnetically attractive structures positioned, when the rotating door is in the closed position, to urge the rotating door to remain in the closed position; and one or more traction structures extending downward from an exterior surface of the concave main body, the one or more traction structures positioned, sized, and shaped to laterally engage the grass-covered ground to resist the golf club head cover from moving laterally on the grass-covered ground when the head of the golf club is placed into and removed from the rigid cover without a user touching the rigid cover.

7. The rigid cover of claim 1, further comprising:

one or more second magnetically repulsive structures positioned, when the rotating door is in the open position, to urge the rotating door to remain in the open position.

8. A method of placing a head of a golf club into a rigid cover without a user touching the rigid cover, comprising the steps of:

providing a golf club comprising a head, shaft, and handle;

providing the rigid cover of claim 1 with the rotating concave member in the open position;

holding the golf club by the handle and guiding the head of the golf club at least partially into the first open cavity of the concave main body; and contacting the first tab with the head of the golf club and causing the rotating concave member to rotate from the open position to the closed position.

9. The method of claim 8, further including removing the head of the golf club from the rigid cover without the user touching the rigid cover, further comprising the steps of:

holding the golf club by the handle and contacting the inner surface of the rotating concave member with the head of the golf club;

overcoming the urging force of the one or more first magnetically attractive structures;

causing the rotating concave member to rotate from the closed position to the open position; and guiding the head of the golf club out of the first open cavity of the concave main body.

10. A method of placing a head of a golf club into a rigid cover without a user touching the rigid cover, comprising the steps of:

providing a golf club comprising a head, shaft, and handle;

providing the rigid cover of claim 5 with the rotating concave member in the open position, and, with the one or more traction structures placed on grass-covered ground:

holding the golf club by the handle and guiding the head of the golf club at least partially into the first open cavity of the concave main body; and contacting the first tab with the head of the golf club and causing the rotating concave member to rotate from the open position to the closed position.

11. The method of claim 10, the method further comprising performing the following steps with the one or more traction structures placed on grass-covered ground:

holding the golf club by the handle and contacting the inner surface of the rotating concave member with the head of the golf club;

overcoming the urging force of the one or more first magnetically attractive structures;

causing the rotating concave member to rotate from the closed position to the open position; and guiding the head of the golf club out of the first open cavity of the concave main body.

12. The method of claim 8, the method further comprising the steps of:

overcoming the urging force of the one or more first magnetically repulsive structures when causing the rotating concave member to rotate from the open position to the closed position.

13. A method of placing a head of a golf club into a rigid cover without a user touching the rigid cover, comprising the steps of:

providing a golf club comprising a head, shaft, and handle;

providing the rigid cover of claim 4 with the rotating concave member and the rotating door both in their open positions;

holding the golf club by the handle and guiding the head of the golf club at least partially into the first open cavity of the concave main body;

guiding the shaft of the golf club at least partially into the third open cavity of the concave upper portion;

contacting the first tab with the head of the golf club and causing the rotating concave member to rotate from the open position to the closed position; and contacting the second tab with the shaft of the golf club and causing the rotating door to rotate from the open position to the closed position.

14. The method of claim 13, further including removing the head of the golf club from the rigid cover without the user touching the rigid cover, further comprising the steps of:

holding the golf club by the handle and contacting the inner surface of the rotating concave member with the head of the golf club;

contacting the inner surface of the rotating door with the shaft of the golf club;

overcoming the urging force of the one or more first and second magnetically attractive structures;

causing the rotating concave member to rotate from the closed position to the open position;

causing the rotating door to rotate from the closed position to the open position;

guiding the head of the golf club out of the first open cavity of the concave main body; and guiding the shaft of the golf club out of the third open cavity of the concave upper portion.

15. A method of placing a head of a golf club into a rigid cover without a user touching the rigid cover, the method comprising the steps of:

providing a golf club comprising a head, shaft, and handle;

providing the rigid cover of claim 6 with the rotating concave member and the rotating door both in their open positions, and, with the one or more traction structures placed on grass-covered ground:

holding the golf club by the handle and guiding the head of the golf club at least partially into the first open cavity of the concave main body;

guiding the shaft of the golf club at least partially into the third open cavity of the concave upper portion;

contacting the first tab with the head of the golf club and causing the rotating concave member to rotate from the open position to the closed position; and contacting the second tab with the shaft of the golf club and causing the rotating door to rotate from the open position to the closed position.

16. The method of claim 15, the method further comprising performing the following steps with the one or more traction structures placed on grass-covered ground:

holding the golf club by the handle and contacting the inner surface of the rotating concave member with the head of the golf club;

contacting the inner surface of the rotating door with the shaft of the golf club;

overcoming the urging force of the one or more first and second magnetically attractive structures;

causing the rotating concave member to rotate from the closed position to the open position;

causing the rotating door to rotate from the closed position to the open position;

guiding the head of the golf club out of the first open cavity of the concave main body; and guiding the shaft of the golf club out of the third open cavity of the concave upper portion.

17. A method of placing a head of a golf club into a rigid cover without a user touching the rigid cover, comprising the steps of:

providing a golf club comprising a head, shaft, and handle;

providing the rigid cover of claim 4 with the rotating concave member and the rotating door both in their open positions, the rigid cover further comprising one or more second magnetically repulsive structures positioned, when the rotating door is in the open position, to urge the rotating door to remain in the open position;

holding the golf club by the handle and guiding the head of the golf club at least partially into the first open cavity of the concave main body;

guiding the shaft of the golf club at least partially into the third open cavity of the concave upper portion;

contacting the first tab with the head of the golf club and causing the rotating concave member to rotate from the open position to the closed position;

contacting the second tab with the shaft of the golf club and causing the rotating door to rotate from the open position to the closed position;

overcoming the urging force of the one or more first magnetically repulsive structures when causing the rotating concave member to rotate from the open position to the closed position; and overcoming the urging force of the one or more second magnetically repulsive structures when causing the rotating door to rotate from the open position to the closed position.

18. A method of placing a head of a golf club into a rigid cover without a user touching the rigid cover, comprising the steps of:

providing a golf club comprising a head, shaft, and handle;

providing the rigid cover of claim 2 with the rotating concave member in the open position;

holding the golf club by the handle and guiding the head of the golf club at least partially into the first open cavity of the concave main body;

contacting the first tab with the head of the golf club and causing the rotating concave member to rotate from the open position to the closed position; and moving the shaft in the slot during the step of guiding the head of the golf club at least partially into the first open cavity of the concave main body.

19. A method of placing a head of a golf club into a rigid cover without a user touching the rigid cover, comprising the steps of:

providing a golf club comprising a head, shaft, and handle, wherein the shaft is connected to the head of the golf club;

providing a rigid cover having the elements of claim 4, the concave main body defining a slot there-through positioned, sized, and shaped to provide clearance for movement of the shaft as the head of the golf club enters and exits the first open cavity, with the rotating concave member and the rotating door both in their open positions;

holding the golf club by the handle and guiding the head of the golf club at least partially into the first open cavity of the concave main body;

guiding the shaft of the golf club at least partially into the third open cavity of the concave upper portion;

contacting the first tab with the head of the golf club and causing the rotating concave member to rotate from the open position to the closed position;

contacting the second tab with the shaft of the golf club and causing the rotating door to rotate from the open position to the closed position; and moving the shaft in the slot during the step of guiding the head of the golf club at least partially into the first open cavity of the concave main body.

20. The method of claim 19, the method further comprising the steps of:

holding the golf club by the handle and contacting the inner surface of the rotating concave member with the head of the golf club;

contacting the inner surface of the rotating door with the shaft of the golf club;

overcoming the urging force of the one or more first and second magnetically attractive structures;

causing the rotating concave member to rotate from the closed position to the open position;

causing the rotating door to rotate from the closed position to the open position;

guiding the head of the golf club out of the first open cavity of the concave main body;

guiding the shaft of the golf club out of the third open cavity of the concave upper portion; and moving the shaft in the slot during the step of guiding the head of the golf club out of the first open cavity of the concave main body.

* * * * *